US005401197A

United States Patent [19]

Kobayashi

[11] Patent Number: 5,401,197

[45] Date of Patent: Mar. 28, 1995

[54] HULL

[75] Inventor: Noboru Kobayashi, Iwata, Japan

[73] Assignee: Yamaha Hatsudoki Kabushiki Kaisha, Iwata, Japan

[21] Appl. No.: 114,660

[22] Filed: Aug. 31, 1993

[30] Foreign Application Priority Data

Sep. 4, 1992 [JP] Japan ..... 4-237271

[51] Int. Cl.[6] ..... B63H 11/00

[52] U.S. Cl. ..... 440/38; 114/274; 114/290; 440/53

[58] Field of Search ..... 114/271, 270, 274, 290, 114/291, 280, 282, 284, 67 A; 440/38, 42, 62, 63, 53, 111

[56] References Cited

U.S. PATENT DOCUMENTS

| | | | |
|---|---|---|---|
| 2,593,806 | 4/1952 | Steele | 114/270 |
| 2,931,332 | 4/1960 | Hebrank | 114/270 |
| 3,082,732 | 3/1963 | Stallman | 440/42 X |
| 3,136,288 | 6/1964 | Hardy | 440/111 X |
| 3,149,600 | 9/1964 | Traksel | 440/42 X |
| 3,213,822 | 10/1965 | Sawchuk | 114/270 |
| 3,382,833 | 5/1968 | Wukowitz | 440/38 X |
| 3,623,447 | 11/1971 | Jacobson | 114/270 |
| 3,718,111 | 2/1973 | Del Vecchio | 114/270 |
| 3,812,814 | 5/1974 | Veilleux | 114/67 A X |
| 4,392,445 | 7/1983 | Burg | 114/67 A |
| 4,529,386 | 7/1985 | Smith | 440/54 |
| 4,756,265 | 7/1988 | Lane | 114/274 X |
| 4,924,797 | 5/1990 | Solia | 114/291 X |
| 5,140,930 | 8/1992 | Lund | 114/290 X |

*Primary Examiner*—Sherman Basinger
*Attorney, Agent, or Firm*—Knobbe, Martens, Olson & Bear

[57] ABSTRACT

A number of embodiments of hull arrangements for watercraft that permit forward positioning of the propulsion device but also permit the hull to be constructed as a planing hull. In some embodiments, jet propulsion devices are disclosed and in another embodiment an outboard motor propulsion device is shown.

18 Claims, 13 Drawing Sheets

HULL

BACKGROUND OF THE INVENTION

This invention relates to hull for a watercraft and more particularly to an improved watercraft having a forwardly positioned propulsion unit.

In most types of watercraft the propulsion for the watercraft is positioned at the rear of the hull portion. This is true regardless of whether the watercraft is propelled by a propeller or a jet propulsion unit. Also, such rear propulsion devices are employed regardless of whether the watercraft is powered by an inboard mounted engine or by an outboard motor. There are certain disadvantages to the rear positioning of the propulsion unit.

Specifically, when the propulsion is positioned at the rear of the hull the positioning of the propulsion unit and the drive for it causes a large proportion of the weight of the watercraft to be located in an aft location. It is not always desirable to have such an aft biased weight distribution.

In addition, the rearward positioning of the propulsion unit and the drive for it can encroach an area where it is desirable to provide passengers space. Even if the propulsion unit is mounted at the rear and the driving engine is located forwardly, the drive shaft will extend through the passenger compartment or otherwise provide obstructions.

It is, therefor, a principle object of this invention to provide an improved hull configuration and watercraft wherein the propulsion unit for the watercraft is positioned at the bow rather the stern end of the watercraft.

It is a further object of this invention to provide an improved hull construction for a watercraft wherein the propulsion unit is forwardly positioned so as to permit the use of a larger and unobstructed passengers area.

As has been noted, the typical propulsion units for watercraft have embodied either jet propulsion units or propellers and each of these propulsion devices operated by moving water past an impeller or the impeller through the water. It is desirable, of course, to have an unobstructed path for the water discharge so as to improve the propulsion efficiency. With the previously proposed types of watercraft hull this has made it difficult to provide a forwardly positioned propulsion unit.

It is, therefor, a still further object of this invention to provide an improved hull configuration for a watercraft that permits forward placement and yet unobstructed water flow from the propulsion unit.

Planing hulls are quite popular for watercraft and they have a number of advantages. The primary advantage is that the planing type hull reduces the amount of submerged volume of the hull when traveling at speed and thus permits higher speeds with lower power. However, it is difficult to provide a planing hull and a forward positioned propulsion unit.

It is, therefor, a still further object of this invention to provide an improved hull configuration that permits the use of a planing hull and, at the same time, a forwardly positioned propulsion unit.

SUMMARY OF THE INVENTION

This invention is adapted to be embodied in a watercraft that is comprised of a hull and a propulsion device for the watercraft that is positioned forwardly in the hull toward the bow end. The propulsion device includes propulsion means cooperating with the body of water in which the watercraft is operating for providing a propulsion force to propel the hull through the body of water.

DETAILED DESCRIPTION OF THE PREFERRED EMBODIMENTS OF THE INVENTION

Figure 1:
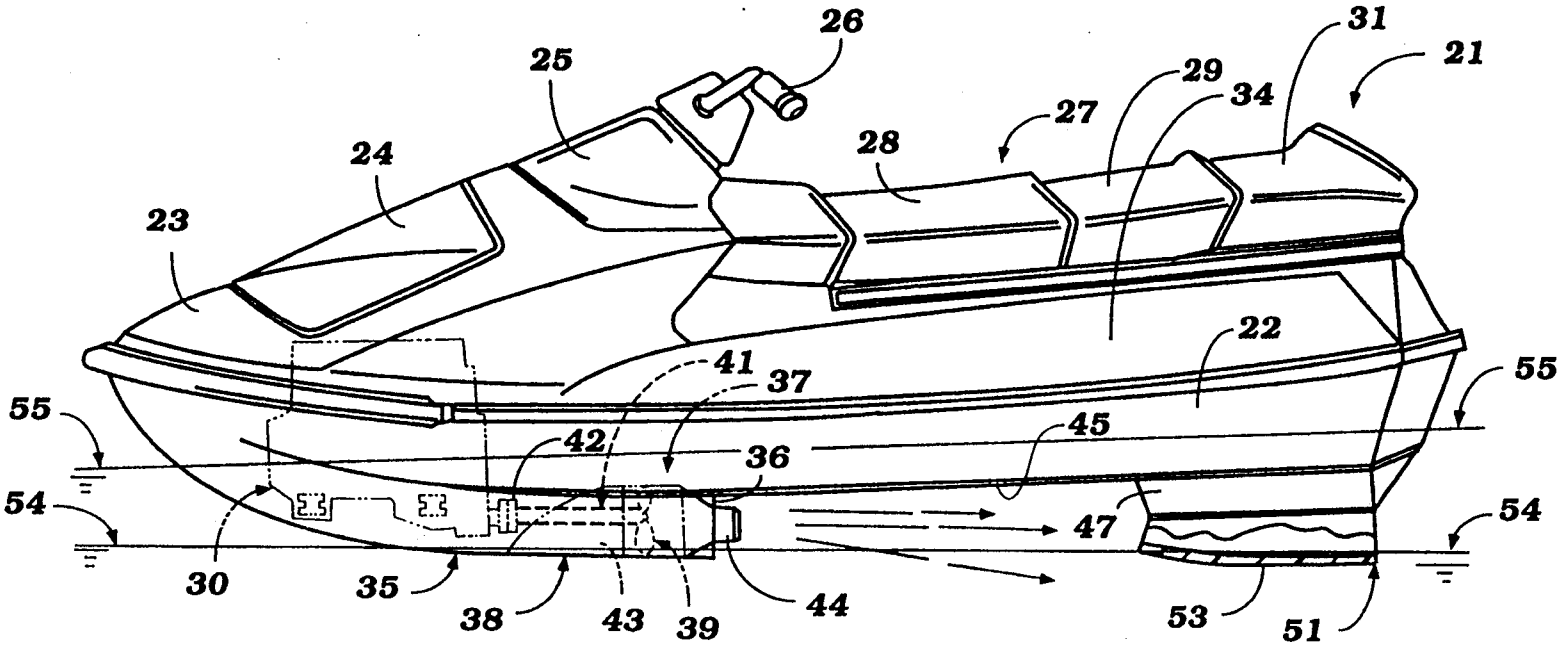
FIG. 1 is a side elevational view of a watercraft constructed in accordance with a first embodiment of the invention, with a portion broken away. The water level lines in this figure show the water level when the watercraft is stationary and when it is traveling at a relatively high rate of speed.
Figure 2:
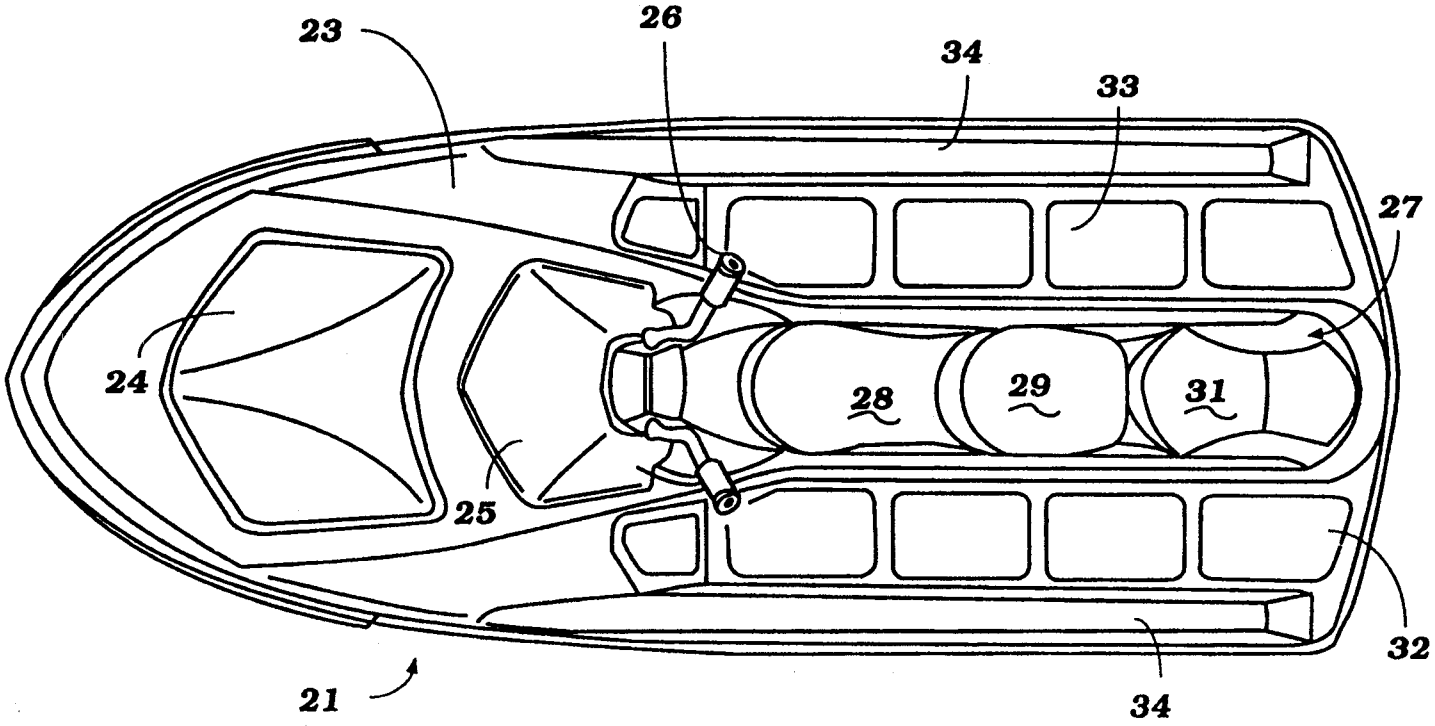
FIG. 2 is a top plan view of the watercraft.

Referring now in detail to the drawings and initially to the embodiment of FIGS. 1–4, a watercraft constructed in accordance with this embodiment is identified generally by the reference numeral 21. The watercraft 21 is comprised of a hull assembly made up of a lower hull part 22 and an upper deck part 23 which parts may be made from any suitable material such as a molded fiberglass reinforced resin or the like. The hull and deck parts 22 and 23 are affixed to each other in any suitable manner and define a forwardly positioned engine compartment that is accessible through a removable hatch cover 24 that may be either pivotally connected to the deck portion 23 or latched to it for removal in any well known manner. The engine and propulsion unit for the watercraft 21 will be described later.

A mast or control area 25 is provided to the rear of the engine cover 24 and carries a control for the watercraft such as a handlebar assembly 26 which may be employed for steering purposes in a manner to be described, and also a motorcycle type throttle control.

Immediately behind the control mast 25 is a riders area, indicated generally by the reference numeral 27 and which is comprised of a raised central area on which a seat comprised of cushions 28, 29 and 31 are supported. A plurality of riders including a operator may be seated in straddle fashion on the seat cushions 28, 29 and 31 with their feet in foot recesses 32 and 33 formed on opposite sides of the raised portion outwardly of the seat cushions 28, 29 and 31. The outer periphery of the foot areas 32 and 33 is defined by raised gunnels 34 which extend from the forward portion of the watercraft rearwardly and terminating at the stern of the watercraft as clearly shown in FIGS. 2 and 3.

The seat cushion 28, 29 and 31 may be removable and preferably are constructed so as to provide floatation. One or more storage compartments may be positioned beneath the seat cushions 28, 29 and 31.

Figure 3:
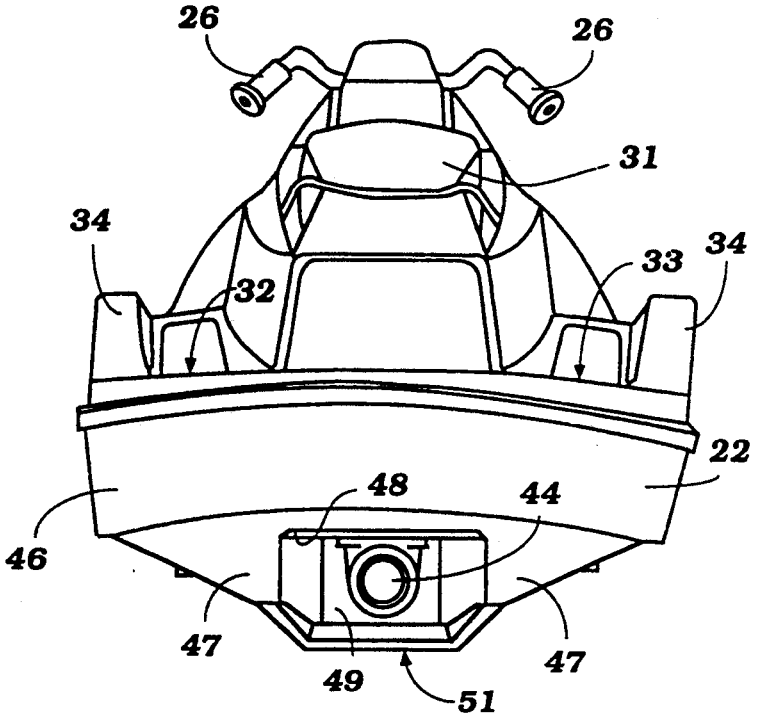
FIG. 3 is a rear elevational view of the watercraft.
Figure 4:
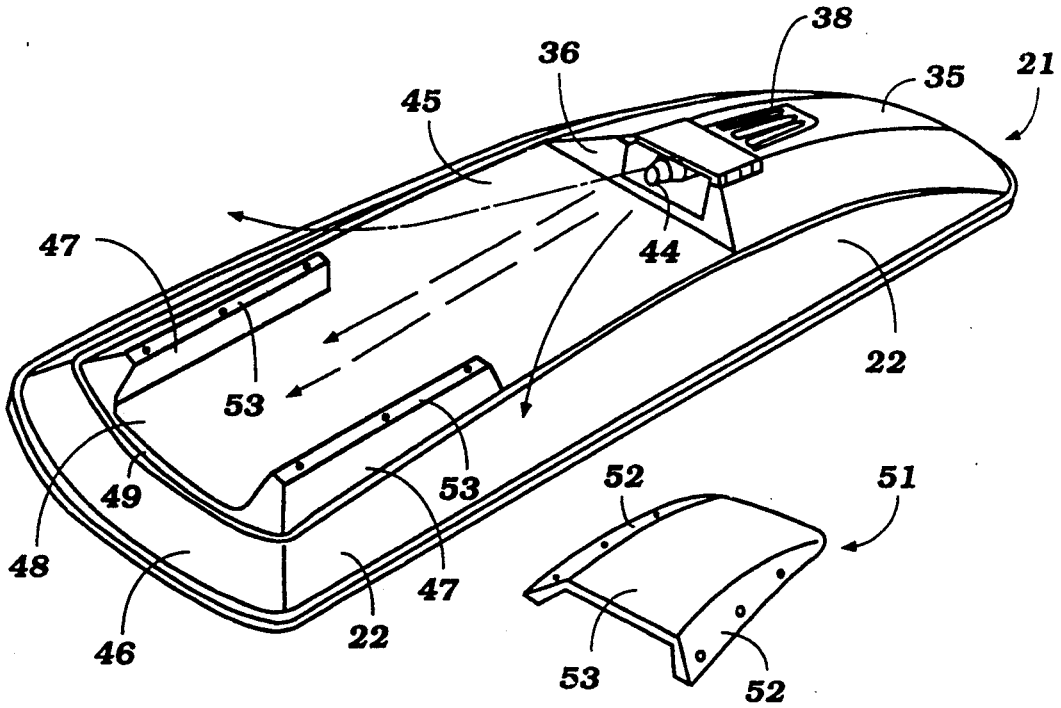
FIG. 4 is partially exploded view of the underside of the watercraft looking from the rear.

As may be best seen in FIGS. 1, 3 and 4, the forward portion of the hull 22 is provided with a downwardly extending area 35 which ends generally forwardly of the forward most seat cushion 28 in a step 36. The propulsion unit for the watercraft 21 is provided in this hull portion 35 and will now be described by primary reference to these figures.

The propulsion unit includes an internal combustion engine 30 that is positioned within the aforenoted engine compartment below the removable hatch 24. The engine 30 may be of any known type and drives a jet propulsion unit, indicated generally by the reference numeral 37 that is provided at the rear portion of the hull part 35. This jet propulsion unit includes a downwardly facing water inlet opening covered by a screen 38 through which water is drawn by an impeller 39 which affixed to an impeller shaft 41. The impeller shaft 41 is rotatably coupled to the engine output shaft by means of a coupling 42. Water pumped by the impeller 39 is drawn through the screen 38 and through a water inlet channel 43 formed by the housing of the jet propulsion unit 37 and is discharged rearwardly through a steering nozzle 44 which, as is typical with jet propulsion practice, is supported for steering movement about a vertically extending axis under the control the handlebar assembly 26.

Rearwardly of the jet propulsion unit discharge nozzle 41 and extending rearwardly from the step 36, the underside of the hull 22 is generally plainer, as indicated 45. To the rear of this plainer area 45 and adjacent the transom 46 of the hull portion 22 there are provided a pair of raised ribs 47 that define the peripheral edges of a flat area 48 which forms a continuation of the flat hull under surface 45. A slightly raised area 49 extends between the rear edges of the ribs 47.

The ribs 47 serve two main purposes. The first of these purposes is to afford a discharge channel indicated by the reference numeral 49 in FIG. 3 through which the water flowing from the jet propulsion unit steering nozzle 44 may freely pass when traveling in the straight ahead direction with the flow being shown by the broken arrows in FIG. 4. When steering to right the water flow will pass to one side of the ribs 47 and when steering to the left the water will pass to the other side of the ribs 47 as shown by the dot, dash and sold line arrows in FIG. 4.

In addition to affording the flow channel for the water as described, the ribs also provide stability against side slipping when steering which is desirable due the forward placement of the propulsion unit (the jet propulsion unit 37).

In order to provide lift for the rear of the hull, a cover plate assembly, indicated generally by the reference numeral 51 is provided and this cover plate 51 has side portions 52 that are affixed to flattened lower surfaces 53 of the ribs 47. A curved surface 53 extends between the side portions 52 and is configured so as to provide a hydrofoil type of lift for the rear of the watercraft so that when traveling at high speed only the lower portion of the hull part 35 and the lower surface of the cover 51 will be immersed in the water. This is shown by the water line 54 in FIG. 1. When traveling at low speeds or when the watercraft propulsion is not being operated, the hull of the watercraft 21 will sink lower in the water with this water line being indicated by the line 55 in FIG. 1. Hence, it should be readily apparent that this hull configuration provides a relatively small wetted area when traveling at high speeds and also permits the forward placement of the engine a propulsion unit due to the provision of the ribs 47 and cover plate 51 at the rear of the hull.

Figure 5:
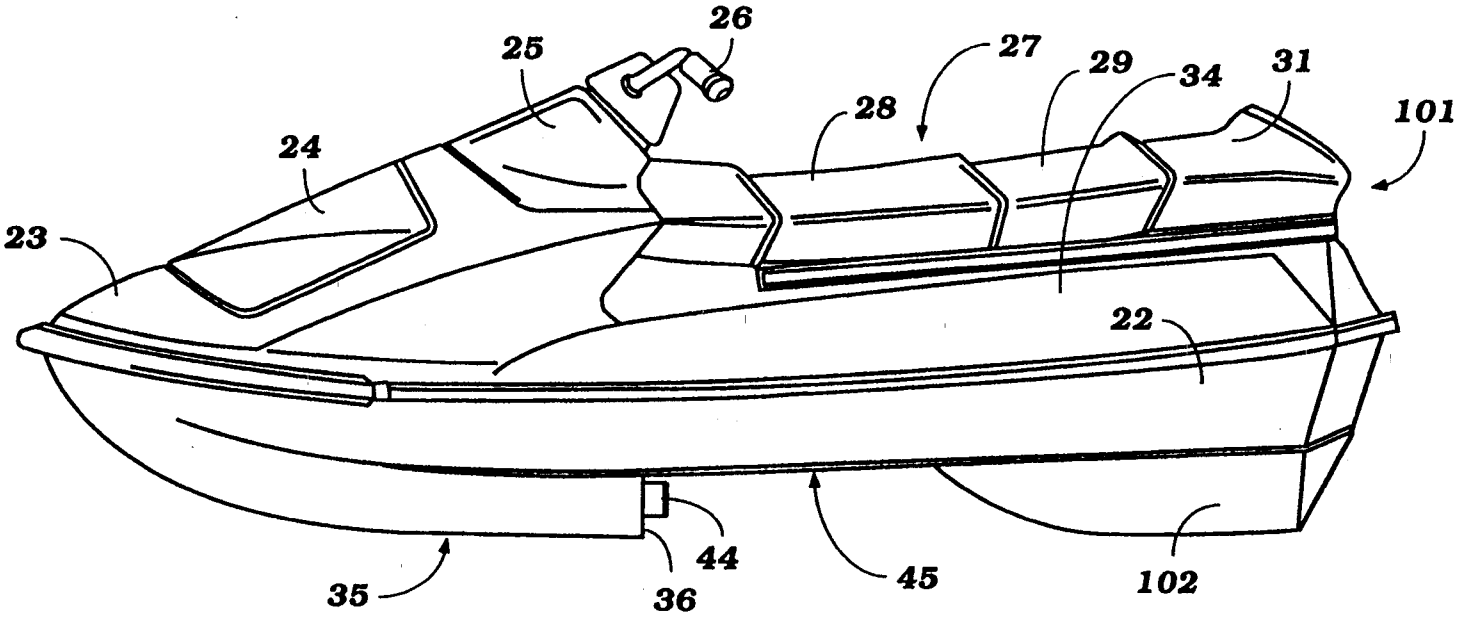
FIG. 5 is a side elevational view, in part similar to FIG. 1, and shows another embodiment of the invention.
Figure 6:
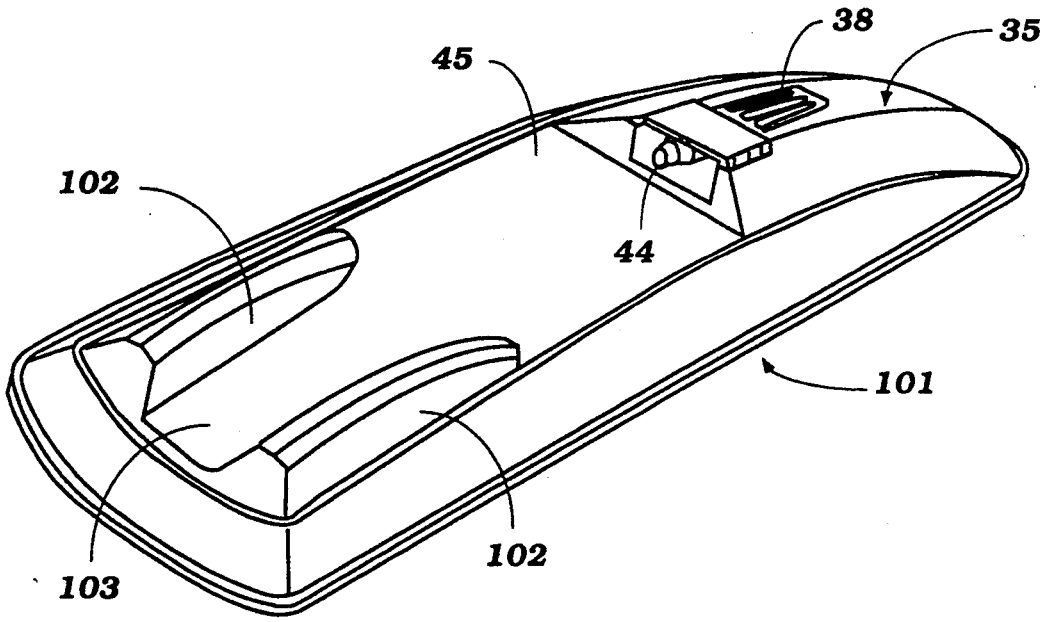
FIG. 6 is bottom perspective view of this embodiment taken from the rear.

FIGS. 5 and 6 show another embodiment of the invention which differs from the embodiment of FIGS. 1–4 only in the way in which the flotation or lift is provided for the rear end of the hull. For that reason, components of this embodiment which are the same or substantially the same as those of the previously described embodiment have been indicated by the same reference numerals and these common components will be described only on so far as is necessary to understand the construction and operation of this embodiment.

This embodiment is indicated generally by the reference numeral 101 and the area to the rear of the hull flattened portion 45 is provided with a pair of catamaran like hull enlargements 102 that are spaced apart so as to define a rearwardly open channel 103 that formes an extension of the hull flattened area 45. Thus, these catamaran like hull portions 102 will provide lift to the rear of the hull 101 when it is traveling due to their tapered configuration and hence this embodiment will ride in the water the same or similarly to the embodiment of FIGS. 1–4. However, when the watercraft is stationary the rear of the hull will be raised slightly more than previously described embodiment due to the buoyancy of the hull portions 102.

Figure 7:
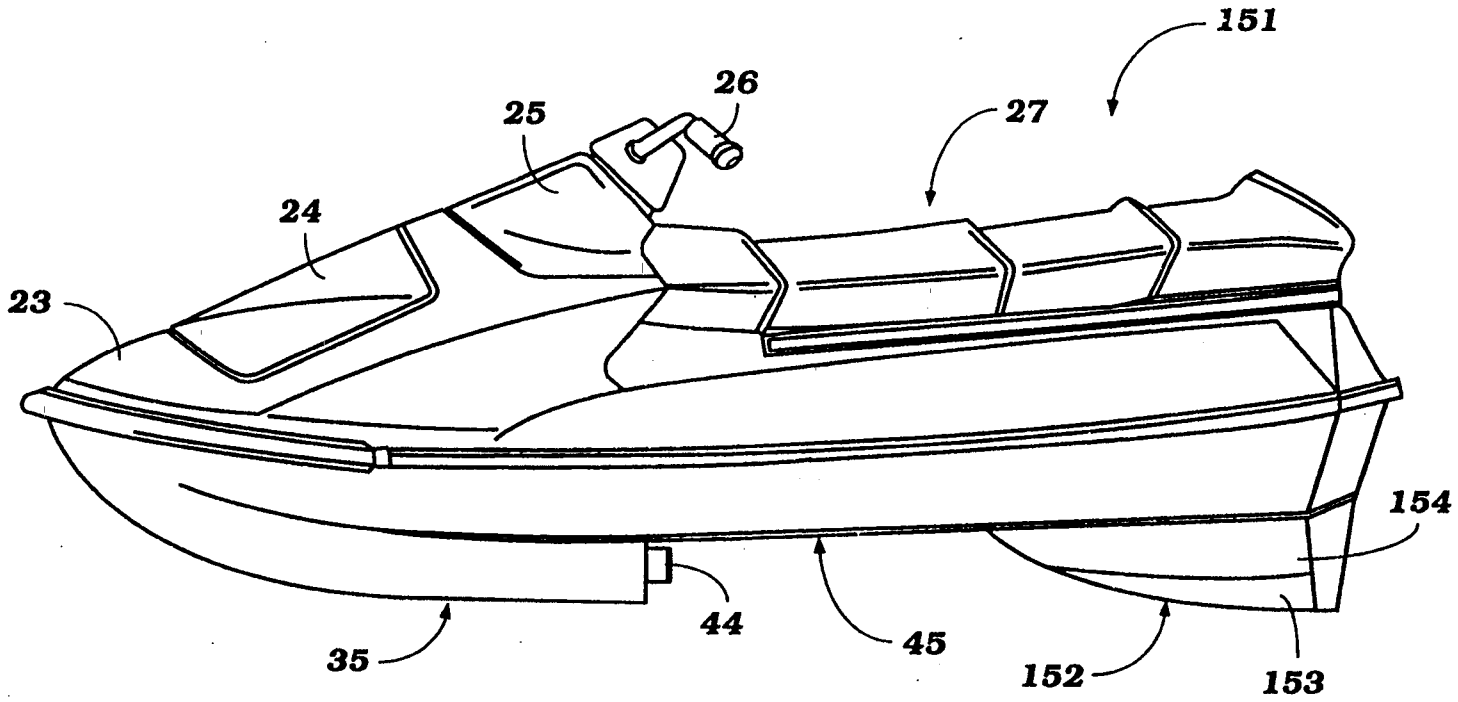
FIG. 7 is a side elevational view, in part similar to FIGS. 1 and 5 and shows a further embodiment of the invention.
Figure 8:
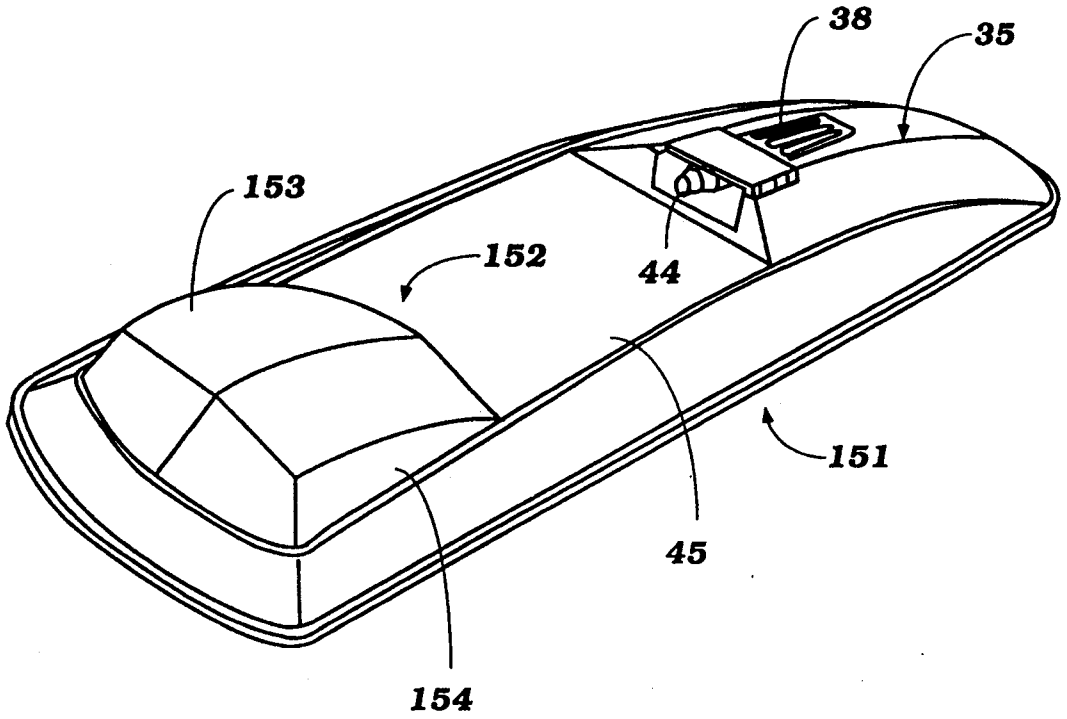
FIG. 8 is a bottom perspective view of this embodiment taken from the rear.

A third embodiment of the invention is shown in FIGS. 7 and 8 and is identified generally by the reference numeral 151. Like the embodiment of FIGS. 5 and 6, this embodiment differs from the embodiment of FIGS. 1–4 only in the manner in which flotation is provided for the rear of the hull. For that reason, components of this embodiment which are the same as the previously described embodiments have been identified by the same reference numerals.

In this embodiment, the area to the rear of the hull at the end of the flattened area 45 is provided with a further hull protrusion, indicated generally by the reference numeral 152 which protrusion has a lower surface 153 which is itself formed like a V-bottom hull and which has side sections 154 which are formed like the sides of a hull and are generally vertically upstanding. The hull surface 153 is configured so as to provide a planing type action as with conventional types of planing hulls and hence although the rear of the hull of the watercraft 151 will ride slightly higher in the water than the embodiment of FIGS. 1–4 when stationary, the hull rear portion will be elevated along with the front portion when the watercraft is traveling at speed.

Figure 9:
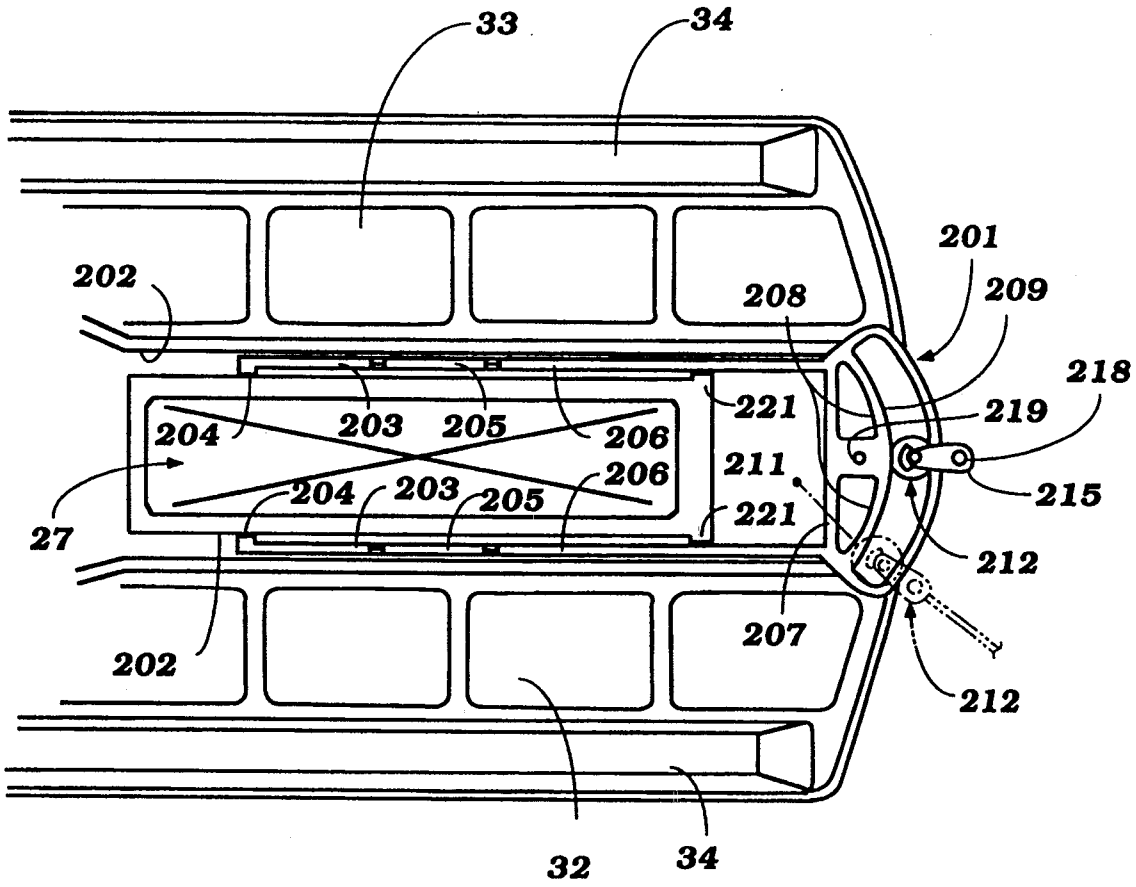
FIG. 9 is an enlarged top plan view which may be typical for any of the embodiments, with a portion broken away to show the boarding ladder and tow rope arrangement.

Referring now to FIGS. 9–13 there will be described a boarding ladder and to wing arrangement, indicated generally by the reference numeral 201 which may be used with any of the embodiments thus far described. The boarding ladder and tow assembly 201 is comprised of a pair of guide channels 202 that are formed by cavity like recesses that extend along the sides of the seating area 27 beneath the seat cushions 28, 29 and 31. A plurality of articulated sections comprised of first side sections 203 having offset ends 204, intermediate sections 205 and end sections 206 are slidably supported within these channels 202. The rear ends of the sections 206 are provided with a combined step and tow assembly 207 that integrally connects the ends of the sections 206. This assembly 207 is provided with a pair of foot recesses 208 and an arcuate track section 209 that has a center of curvature 211 that is positioned forwardly of the rear of the seating area 27 when the boarding ladder tow device 201 is in its stored position as shown in FIG. 9.

Figure 13:
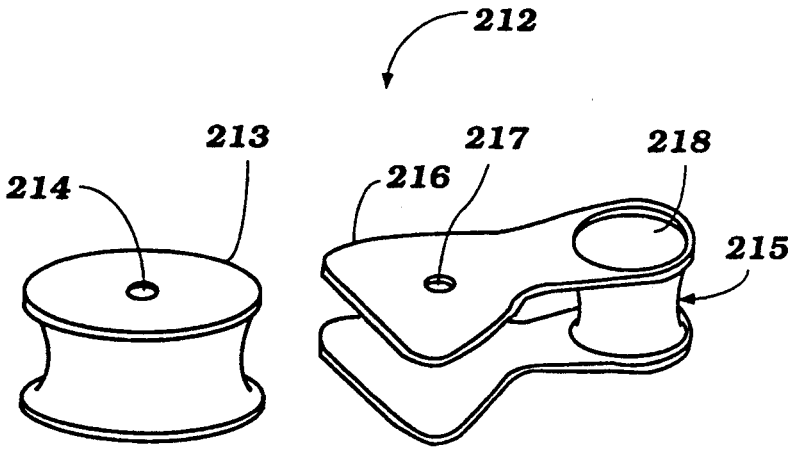
FIG. 13 is an exploded perpective view of the tow rope attachment device.

A tow rope attachment device 212 and having a construction as best seen in FIG. 13 is provided for attachment of a tow rope for towing one or more skiers, in manner which will be described. This tow rope attachment 212 is comprised of a pulley like wheel 213 that is captured within the track opening 209 and which has a central bore 214 that receives a pivot pin (not shown). This pivot pin provide a pivotal attachment between the wheel 213 and a tow attachment member, indicated generally by the reference numeral 215. This member 215 has a pair of legs 216 that span the pulley member 213 and which are aperatured at 217 so as to receive the pivot pin that extends through the pulley aperature 214 to provide a pivotal connection between the member 215 and the pulley 213. The member 215 has a base opening 218 so as to receive a tow rope for towing water skiers as aforenoted.

The cross-piece 207 is further provided an opening 219 that receives a lock pin (not shown) so as to hold the ladder tow assembly 201 in its storage position as shown in FIG. 9. In this position, a water skier may easily move from one side of the watercraft 21 to the other with the tow rope actually being effectively pivoted at the point 211 to the hull forwardly of the end of the seating area 27 so as to provide better towing characteristics.

Figure 10:
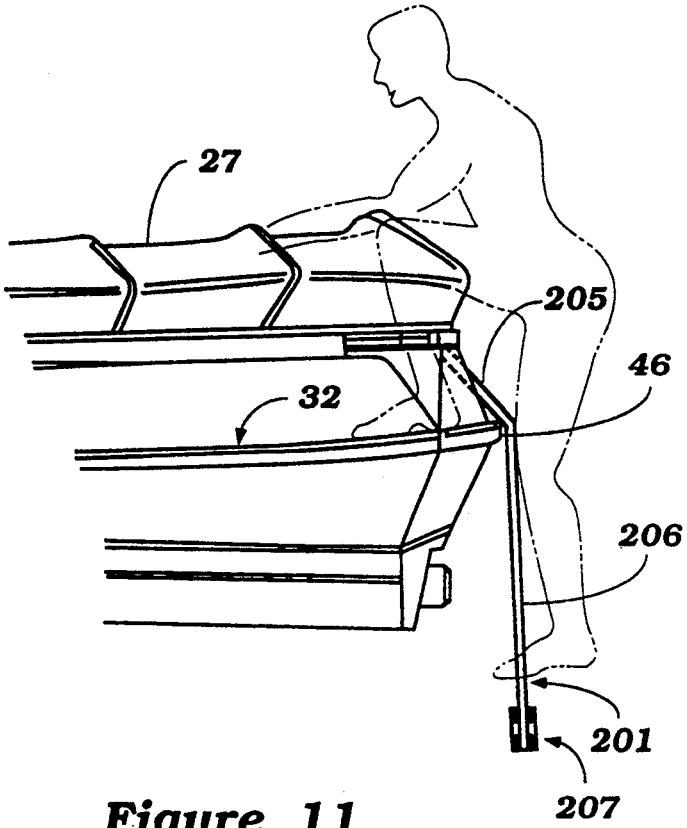
FIG. 10 is a partial rear elevational view typical for any embodiment and shows the boarding ladder in its extended boarding position.
Figure 11:
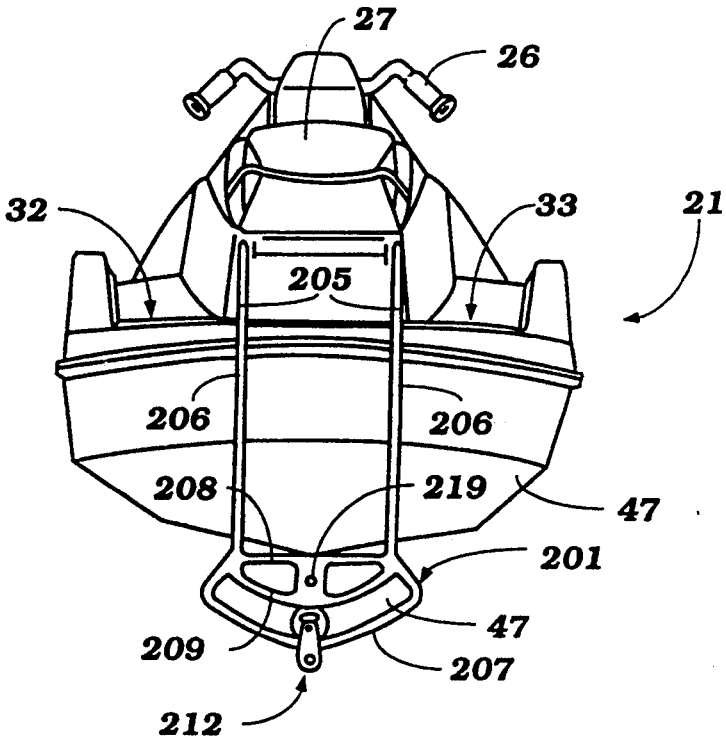
FIG. 11 is rear elevational view of the construction shown is FIG. 10 and in that condition.
Figure 12:
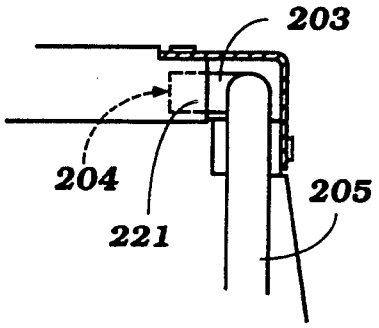
FIG. 12 is an enlarged cross-sectional view showing the arrangement for supporting the upper end of the boarding ladder.

For boarding purposes, the pin in the aperature 219 is removed and the ladder tow assembly 201 is pulled rearwardly to the position shown in FIG. 10. A pair of stop logs 221 are formed at the ends of the channels 202 (FIG. 9) and are engaged by the offset ends 207 of the ladder sections 203 so as to restrain further rearward movement. The section 205 will then form an angular relationship to contact the rear portion of the transom 46 as shown in FIG. 10 with the section 206 thus depending downwardly into the body of water in which the watercraft is operating so that a person in water may place his feet in the foot openings 208 as shown in FIG. 10 so as to easily board the watercraft.

In the embodiment as thus far described the portion 207 extends rearwardly of the seat. It is to be understood that the area beneath the seat cushion 31 may be formed with a suitable recess so that even this portion can be concealed. Also, rather than employing the plurality of hinge sections as described, solid sides may be utilized for the ladder assembly.

Figure 14:
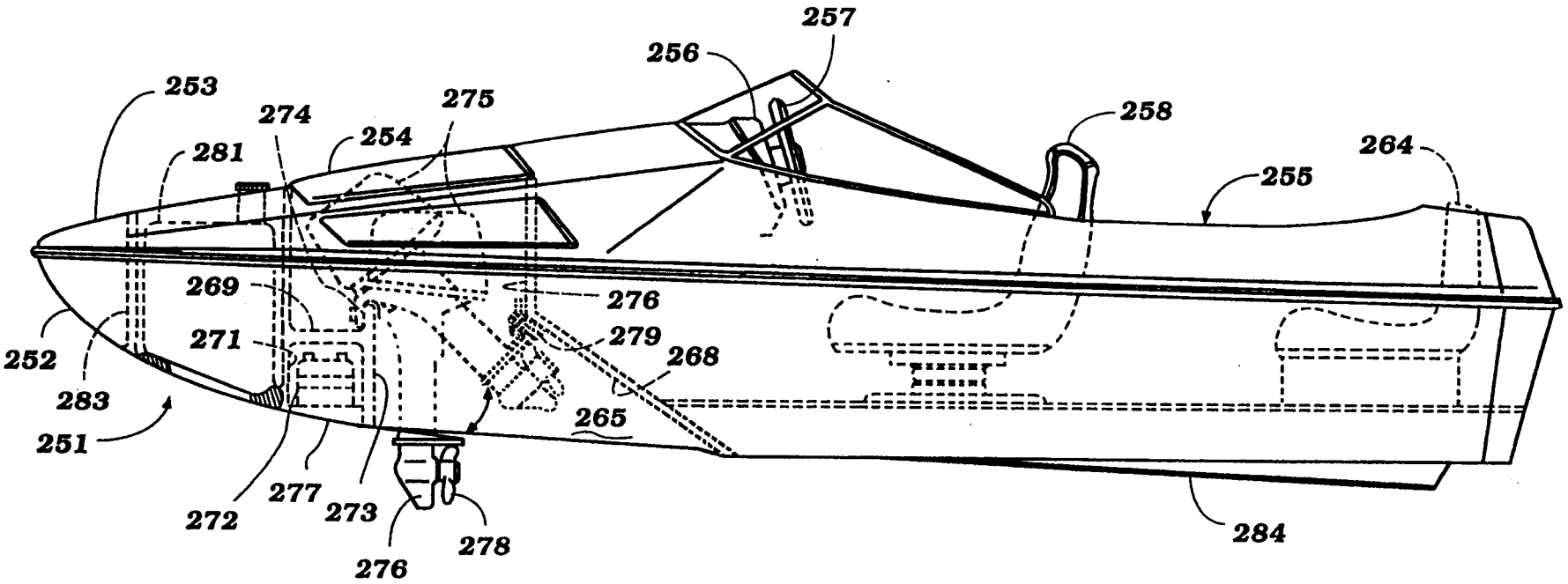
FIG. 14 is a side elevational view, in part similar to FIGS. 1, 5 and 7 and shows yet another embodiment of the invention.
Figure 15:
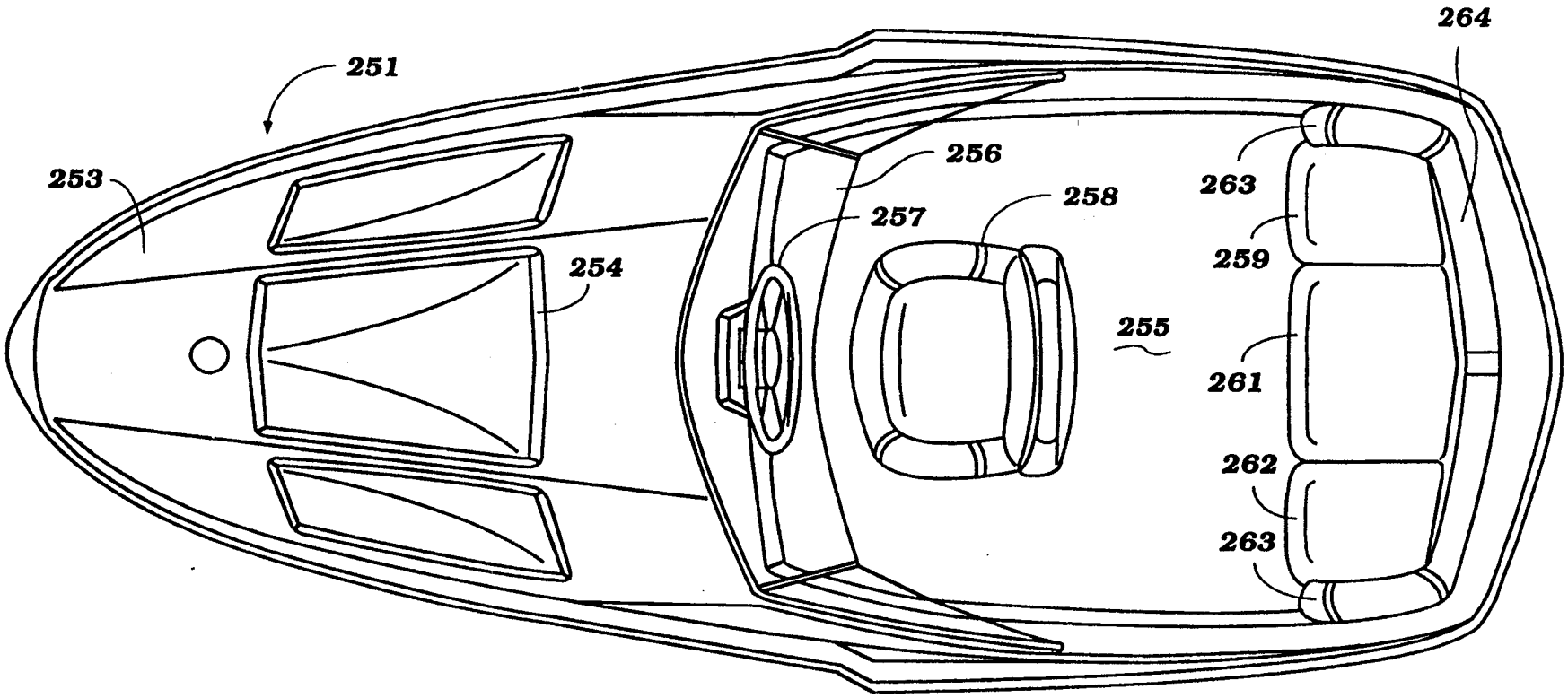
FIG. 15 is a top plan view of the watercraft of this embodiment.
Figure 16:
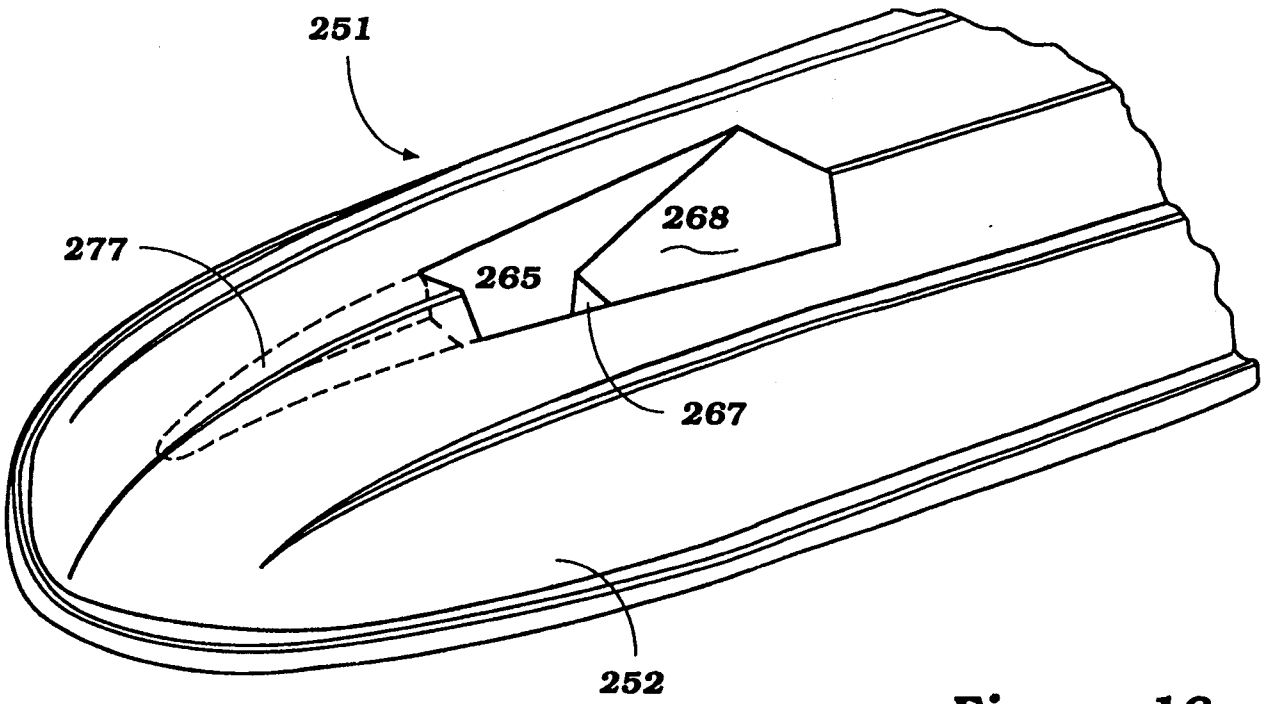
FIG. 16 is a bottom perspective view looking from the front and showing the underside of the hull of this embodiment.

In the embodiments of the invention as thus far described the propulsion device for the watercraft has been comprised of a jet propulsion unit. It is to be understood that the invention may also be employed with propeller driven watercraft and FIGS. 14–16 show such an embodiment.

The watercraft in this embodiment is identified generally by the reference numeral 251 and like all of the previously described embodiments the watercraft 251 has a hull made up of a lower hull portion 252 and an upper deck portion 253. As with the previously described embodiments, the hull portion 252 and deck portion 253 may be formed from any suitable material such as a molded fiberglass reinforced resin or the like. Also, like the previously described embodiments, the forward portion of the watercraft 251 defines an enclosed area that contains at the forward end the propulsion device for the watercraft. This propulsion device is accessible through a removable hatch cover 254 which may be pivotally connected to the deck portion 253 or removably attached to it by latches.

Rearwardly of this forward portion and the hatch cover 254 the deck portion 253 is provided with a passengers compartment, indicated generally by the reference numeral 255. In this particular embodiment, the passengers compartment provides a different seating arrangement for the passengers but it is to be understood that the forward drive propeller concept may also be employed with watercraft having a seating arrangement as with the embodiments of FIGS. 1–4, 5 and 6 and 7 and 8.

The passengers compartment 255 includes a forward control panel 256 that mounts a steering control 257 and other appropriate controls as may be desired. An operators seat 258 is positioned centrally in the forward portion of the passenger compartment 255 for ready access to the steering wheel 257. At the rear portion of the passengers compartment 255 there are provided three transversely extending seat cushions 259, 261 and 262 that have side arm rests 263 and a back rest 264. The side by side seating of this hull permits any number of passengers to be carried while still maintaining side to side balance. For example, if there is one passenger and the operator the single passenger may sit on the center seat cushion 261 to achieve side by side balance. If there are two passengers, they can sit in the side seat cushions 259 and 262 so as to maintain side to side balance. Three passengers obviously can also be accommodated without upsetting the balance.

As may be seen from the bottom view of FIG. 16 the hull portion 252 has a generally V-shaped hull of the planing type. However, there is an interrupted central void area, indicated generally by the reference numeral 265 for a purpose that will now be described by particular reference to FIGS. 14 and 16.

The void area 265 is defined by a forward bulkhead 266 and a rearward bulkhead 267 which rearward bulkhead has a vertically extending portion extending downwardly from the deck 253 and an inclined portion 268 for a reason which will become apparent.

From the bulkhead 266 there extends rearwardly a horizontal wall 269 that defines a storage compartment 271 in which an accessory such as a battery or batteries 272 may be mounted. These batteries can be accessible through a removable cover (not shown) and which may be of any type. A rearwardly positioned wall 273 defines the rear end of the storage compartment 271 and has an upwardly extending lip 274 on which an outboard motor, indicated generally by the reference numeral 275 is mounted by its normal clamping bracket. In the solid line view of FIG. 14 the outboard motor 275 is shown in its lower driving position. In this position, the lower unit 276 depends below the lower wall 277 of the hull portion. 256 so that the propeller 278 will be at least partially submerged in the body of water in which the watercraft is operating so as to propel the watercraft.

The other details of the outboard motor 275 are not illustrated because it is believed that those skilled in the art will readily understand how any conventional type of outboard motor can be utilized with the hull of this embodiment. However, it should be noted that, as is typical with outboard motor practice, the outboard motor 275 is mounted for steering movement about a generally vertically extending steering axis and may be coupled to the steering wheel 257 by any well know type of watercraft steering mechanism.

In addition, the outboard motor 275, as is also typical with outboard motor practice, is supported for tilt and trim movement about a horizontally extending axis. The outboard motor 275 also, as is further typical with outboard motor practice can pivot about this axis when an underwater obstacle is struck so as to avoid damage and the phantom line view of FIG. 14 shows such a tilted up condition. Any type of bumper stop 279 may be carried on the inclined wall portion 268 to contact a robust portion of the outboard motor so as to limit the degree of such upward movement. In addition, the outboard motor 275 may be tilted up to this position when it is not being employed to power the watercraft.

Forwardly of the cavity 265 and of the bulkhead 266 other accessories for the outboard motor 275 may be contained such as a fuel tank 281, oil tank (not shown) or other accessories. These tanks have fill necks with caps 282 that extend through the deck 253 forwardly of the hatch cover 254 so they may be refilled without opening the hatch cover 254.

A forward bulkhead 283 may also be provided and the forward area of the watercraft can either serve as another storage compartment or can be filled with a buoyant material so as to improve the buoyancy.

Unlike the previously described embodiments, the hull under surface 277 in this embodiments extends continuously back to the transom of the watercraft except for the opening provided by the cavity 265. This reduces the need for providing the buoyancy or lift devices of the previously described embodiment. However, there are provided a pair of transversely spaced apart keel portions 284 which serve the purpose of avoiding side slipping during turning which might otherwise occur due to the forward position of the propulsion unit.

It should be readily apparent from the foregoing description that the embodiments of the invention are very effective in providing forward propulsion units either of the propeller or the jet propulsion type. In the propeller embodiment shown an outboard motor has been employed for the propulsion unit but it understood that the concept may also be employed with an inboard/outboard drive in a forward position. Various other changes and modifications may be made from the described embodiments, which are only preferred embodiments, without departing from the spirit and scope of the invention, as defined by the appended claims.

I claim:

1. A watercraft comprised of a hull, a propulsion device for said watercraft positioned forwardly in said hull toward a bow end thereof, said propulsion device including propulsion means for cooperating with the body of water in which said watercraft is operating for providing a propulsion force to propel said hull through said body of water, said hull having a buoyant front portion extending from said bow and defining a step in said hull where the propulsion device is located and at a forward position thereon and defined by a generally flat undersurface spaced vertically above said front portion, and flotation means formed at the rear of said hull for raising said hull into a planing condition when traveling at speed.

2. A watercraft as set forth in claim 1 wherein the propulsion device comprises a jet propulsion unit with a discharge nozzle being positioned adjacent the step.

3. A watercraft as set forth in claim 2 further including an engine positioned in the hull at the forward end thereof and driving the jet propulsion unit.

4. A watercraft as set forth in claim 1 wherein the flotation means comprises a hydrofoil section.

5. A watercraft as set forth in claim 4 wherein the hydrofoil section is comprised of a pair of side ribs and a removable cover so as to provide the lift effect but also so as to permit water to flow there through.

6. A watercraft as set forth in claim 5 wherein the propulsion device comprises a jet propulsion unit with a discharge nozzle being positioned adjacent the step.

7. A watercraft as set forth in claim 6 further including a engine positioned in the hull at the forward end thereof and driving the propulsion device.

8. A watercraft as set forth in claim 1 wherein the flotation means provides an opening through which water contacted by the propulsion device may freely pass.

9. A watercraft as set forth in claim 8 wherein the propulsion device comprises a jet propulsion unit with a discharge nozzle being positioned adjacent the step.

10. A watercraft as set forth in claim 9 further including a engine positioned in the hull at the forward end thereof and driving the propulsion device.

11. A watercraft as set forth in claim 1 wherein the flotation means comprises a V-bottom hull section formed rearwardly of the flat area of the hull.

12. A watercraft as set forth in claim 11 wherein the propulsion device comprises a jet propulsion unit with a discharge nozzle being positioned adjacent the step.

13. A watercraft as set forth in claim 12 further including a engine positioned in the hull at the forward end thereof and driving the propulsion device.

14. A watercraft as set forth in claim 1 wherein the flotation means comprises a pair of catamaran type hull sections disposed at opposite sides of the hull.

15. A watercraft as set forth in claim 14 wherein the propulsion device comprises a jet propulsion unit with a discharge nozzle being positioned adjacent the step.

16. A watercraft as set forth in claim 15 further including a engine positioned in the hull at the forward end thereof and driving the propulsion device.

17. A watercraft comprised of a hull having a generally V bottom, a deck at the front of said hull, a propulsion device for said watercraft comprising an outboard motor having an engine and a propeller driven by said engine positioned forwardly in said hull toward the bow end thereof and beneath said deck, an opening in the lower portion of said hull at the forward end thereof, said propeller depending through said opening for cooperating with the body of water in which said watercraft is operating for providing a propulsion force to propel said hull through said body of water, said outboard motor being pivotal as a unit while remaining beneath said deck about a horizontal axis between a lowered position wherein the propeller is fully immersed in a body of water and a raised position wherein the propeller is fully contained within the hull.

18. A watercraft as set forth in claim 17, wherein the portion of the deck above the engine is formed with an opening and said opening is provided with a removable hatch cover for accessing the outboard motor.

* * * * *